US007114267B2

(12) United States Patent
Fleissner

(10) Patent No.: US 7,114,267 B2
(45) Date of Patent: Oct. 3, 2006

(54) DEVICE FOR TREATING WEB-TYPE GOODS WITH A FLOWING OR PRESSURE MEDIUM

(75) Inventor: Gerold Fleissner, Zug (CH)

(73) Assignee: Fleissner GmbH, Egelsbach (DE)

( * ) Notice: Subject to any disclaimer, the term of this patent is extended or adjusted under 35 U.S.C. 154(b) by 0 days.

(21) Appl. No.: 10/534,509

(22) PCT Filed: Nov. 7, 2003

(86) PCT No.: PCT/EP03/50800

§ 371 (c)(1),
(2), (4) Date: May 11, 2005

(87) PCT Pub. No.: WO2004/044301

PCT Pub. Date: May 27, 2004

(65) Prior Publication Data

US 2006/0021151 A1 Feb. 2, 2006

(30) Foreign Application Priority Data

Nov. 14, 2002 (DE) ..... 102 53 352

(51) Int. Cl.
*F26B 11/02* (2006.01)
*D06B 5/08* (2006.01)

(52) U.S. Cl. ..... 34/115; 34/122; 34/123; 68/5 D

(58) Field of Classification Search ..... 29/896.61, 29/52, 5.02, 525.1, 3, 525.02, 525.13, 6.1; 34/125, 115, 139, 122, 123; 8/148, 151; 68/5 D, 158

See application file for complete search history.

(56) References Cited

U.S. PATENT DOCUMENTS 4,912,945 A * 4/1990 Fleissner ..... 68/5 D
5,052,197 A * 10/1991 Fleissner ..... 68/5 D
5,609,046 A * 3/1997 Fleissner ..... 68/5 D

FOREIGN PATENT DOCUMENTS

DE 0315961 A2 * 11/1988
DE 0753619 A2 * 7/1995
DE 0678613 A2 * 10/1995
DE 10001535 A1 * 7/2001

* cited by examiner

*Primary Examiner*—Kenneth Rinehart
(74) *Attorney, Agent, or Firm*—Antonelli, Terry, Stout and Kraus, LLP.

(57) ABSTRACT

There are known drum jacket constructions that consist solely of perforated sheet metal. There are also known constructions, which, in order to increase the distance between the drum and the surrounding perforated sheet-metal wire gauze, consist of sheet metal with trusses configured e.g. as sheet-metal rings, or of honeycomb sheet-metal strips that are welded together, or of screwed constructions devoid of welding joints. The simplest solution for increasing said distance is a construction comprising a normal screen drum with struts bent into a U-shape that are screwed to the exterior, whereby the wire gauze lies on the external edges of said struts. Said drum however has a low buckling resistance, which is a required characteristic for the drying of tissue or paper. The novel drum jacket construction thus consists of an intersecting structure of sheet-metal strips, whose rings and strips are provided with corresponding insertion slots. The rings and strips are pushed into one another, so that they are at the same radial height and are screwed together. The free flanks of the insertion slots of the sheet-metal strips and also the sheet-metal ring are interconnected in a fixed manner by at least one respective additional connecting plate, using the screws.

21 Claims, 5 Drawing Sheets

DEVICE FOR TREATING WEB-TYPE GOODS WITH A FLOWING OR PRESSURE MEDIUM

Figure 1:
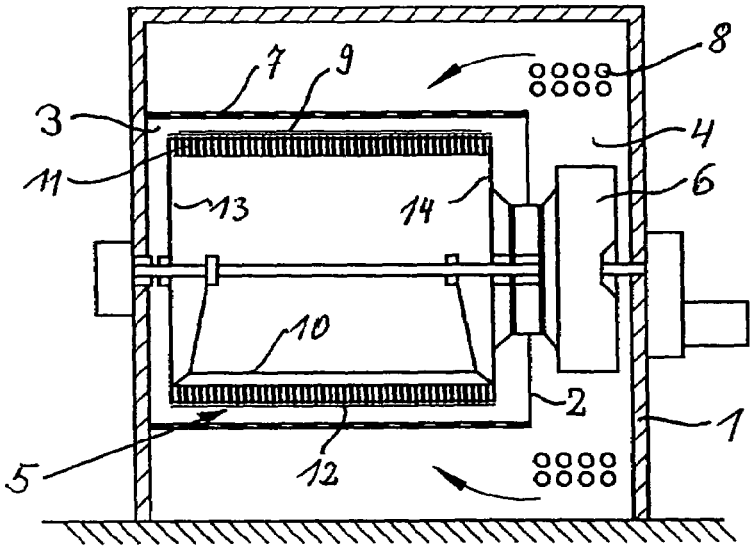

A drum jacket construction is known from DE-A-100 01 535 wherein plate strips extend straight without bending from one bottom to another to form the drum jacket between the bottoms of the drum, the width expansion of said strips extends substantially in the radial direction and plate rings held on the plate strips are distributed uniformly over the length of the drum, wherein plate strips and plate rings can be inserted into one another and both the plate strips and the plate rings are provided with radially directed insertion slots for this purpose.

The previously known jacket construction of a permeable drum is preferably provided for the hydrodynamic needling of nonwovens and the like. In this case, hard water jets are only projected towards the drum along a drum generating line but no surface loading occurs over the circumference of the drum. It is therefore less disturbing if this jacket structure is unstable. On the other hand, if a jacket structure is to be used for heat treatment of textiles, wherein the textiles, nonwovens, tissue or paper are placed over a larger jacket area on the drum for the flowing treatment and are acted upon under surface pressure by a gaseous treatment agent circulated in the device, this unstable construction is no longer suitable.

In this connection, however, reference is made to EP-A-0 315 961 according to which one-piece connecting elements are arranged between the longitudinally extending sheet-metal strips, the width of these strips being constructed according to the desired spacing of the immediately adjacent sheet-metal strips and these strips being fixedly connected to the adjacent sheet-metal strips on both sides by means of a screw. This jacket structure advantageously has a maximally open jacket surface, it is also solid and permanently stable but is expensive to manufacture. The same applies to the device according to EP-A-0 678 613 where, in addition to the open jacket structure, a perforated screen drum is arranged radially inwards under said open jacket structure but because of the air resistance produced, this is used to produce a uniform flow over the working width of the material web.

A simpler and therefore less expensive jacket structure is disclosed in EP-A-0 753 619 wherein U-shaped bent sheet-metal strips spaced apart from one another, extending straight and only parallel over the entire length of the drum from one bottom to the other, are arranged between the screen coating and the drum jacket as an underlayer to increase the spacing between the screen drum and screen coating, whose respective bottom is screwed to the jacket of the sheet-metal drum. This jacket structure ensures a high air permeability for the textiles and also produces a satisfactory pressure head outside the drum as a result of the perforated screen drum but the required buckling resistance of the screen drum at high air pressures on the drum is not ensured. The drum jacket, which actually only has normal perforations, is subjected to high loading fluctuation in the area of the change between the region where the material web lies on the drum and is ventilated as a result of the air pressure and the region where the inner covering internally covers the drum jacket against the air pressure and this loading fluctuation brings about a deformation of the drum which causes the drum to go out of round.

It is the object of the invention to find a drum jacket structure which ensures a high air permeability for the textiles placed on the wire gauze and also guarantees that the jacket structure has a high stiffness without it being so expensive to construct, as is disclosed by the prior art according to the two EP documents first mentioned above.

Starting from a drum jacket structure of the type specified initially, the solution of the object is seen in that the free flanks of the insertion slots of the sheet-metal strips and also the sheet-metal rings are fixedly interconnected by at least one additional connecting plate in each case. In order to bring this about, suitable openings are incorporated at the height of the provided Connecting plates both in the sheet-metal ring and in the sheet-metal strip perpendicular thereto, through which the connecting plate can be pushed and then connected mechanically to the flanks of the slots by screws or rivets. One connecting plate is completely sufficient in each case but it is better if the wall of the sheet-metal strip or sheet-metal ring is covered with such a plate on both sides, at the height of the insertion slots, the openings are thus suitably dimensioned and then three sheets at a time are screwed together. The clamping action of the flanges is produced by the screws or the like but the distance of the respective slot flanks can be precisely adjusted in parallel if the inserted screws are provided with an eccentric and then, by turning the screw head of the screw which has not yet been tightened, the eccentric acts in the circular opening inserted in the sheet-metal strips or sheet-metal rings in the sense of aligning the flanges.

The sheet-metal strips extending straight from bottom to bottom should be provided without slots on their radially outwardly arranged edge since the wire gauze lies on this edge and is therefore supported uninterrupted over the entire length of the drum. On the other hand, the sheet-metal rings must then be provided with matching insertion slots on their radial outer edge. The radial height of the sheet-metal strips and rings can be the same but it is better if the sheet-metal rings are made a smaller size so that the wire gauze only lies on the outer edges of the sheet-metal strips. The slot depths should be incorporated accordingly in the strips and rings. The length of the slots should be such that the stiffness of the sheet-metal strips is undiminished as far as possible, that is the slots only have a short length at their lower edge whereas the corresponding slots of the sheet-metal rings must then be longer. The ensuing reduction in the stability of the rings is unimportant since these rings are only useful for the circular stiffness of the drum whereas the strips must additionally support the material web under air pressure.

The outer edges of the sheet-metal strips thus carry the wire gauze on which the textiles or the like to be treated are placed. It is appropriate if the two longitudinal edges of the outer edge of the sheet-metal strips are at least deburred, better rounded, to avoid unnecessary friction between the wire gauze and the support. However, this rounding treatment of the longitudinal edges is very expensive which is why the invention further proposes to make the sheet-metal strips of the drum from bent sheet metal whose bent edge forms the outer edge of the sheet-metal strip. The two flanges of the bent sheet metal should lie fixedly against one another, whereby the stiffness and the stability of the drum as a whole is increased.

The jacket of the screen drum consisting of the sheet-metal construction which has been screwed together is stable with respect to bending over its entire area. However, because of the uniform distribution of the air to be supplied, it may be necessary to produce a pressure head on the outside of the drum. Naturally, this is already produced by the pre-arranged screen cover but it is better to arrange a perforated screen drum radially underneath the sheet-metal strip structure on which the sheet-metal strip structure is then supported as in EP-A-0 678 613. However, this should also be screwed together with the screen drum for which single rectangular metal clips are advantageous.

Figure 2:
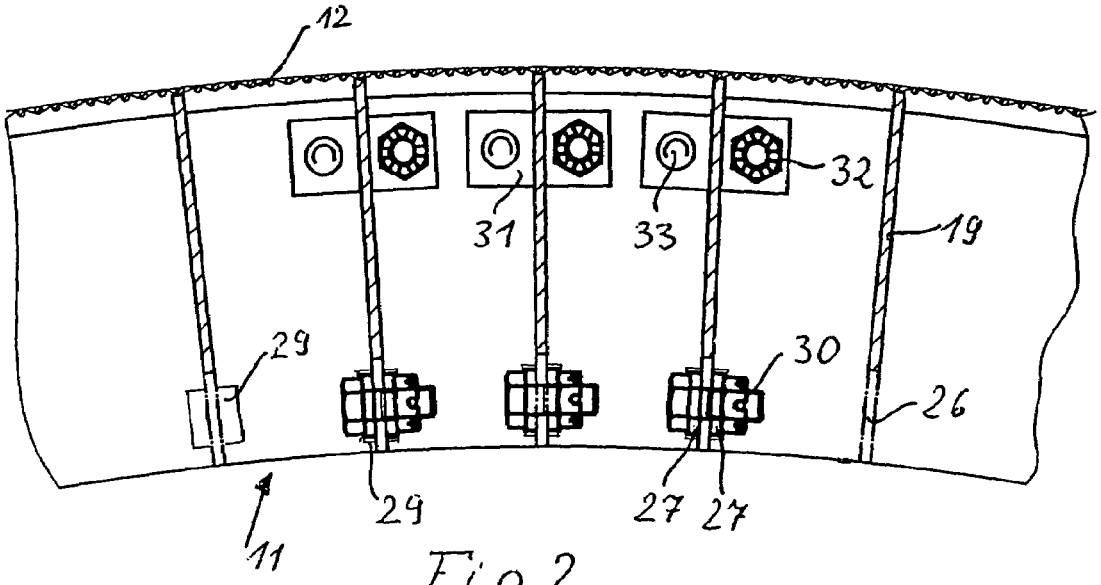
Figure 3:
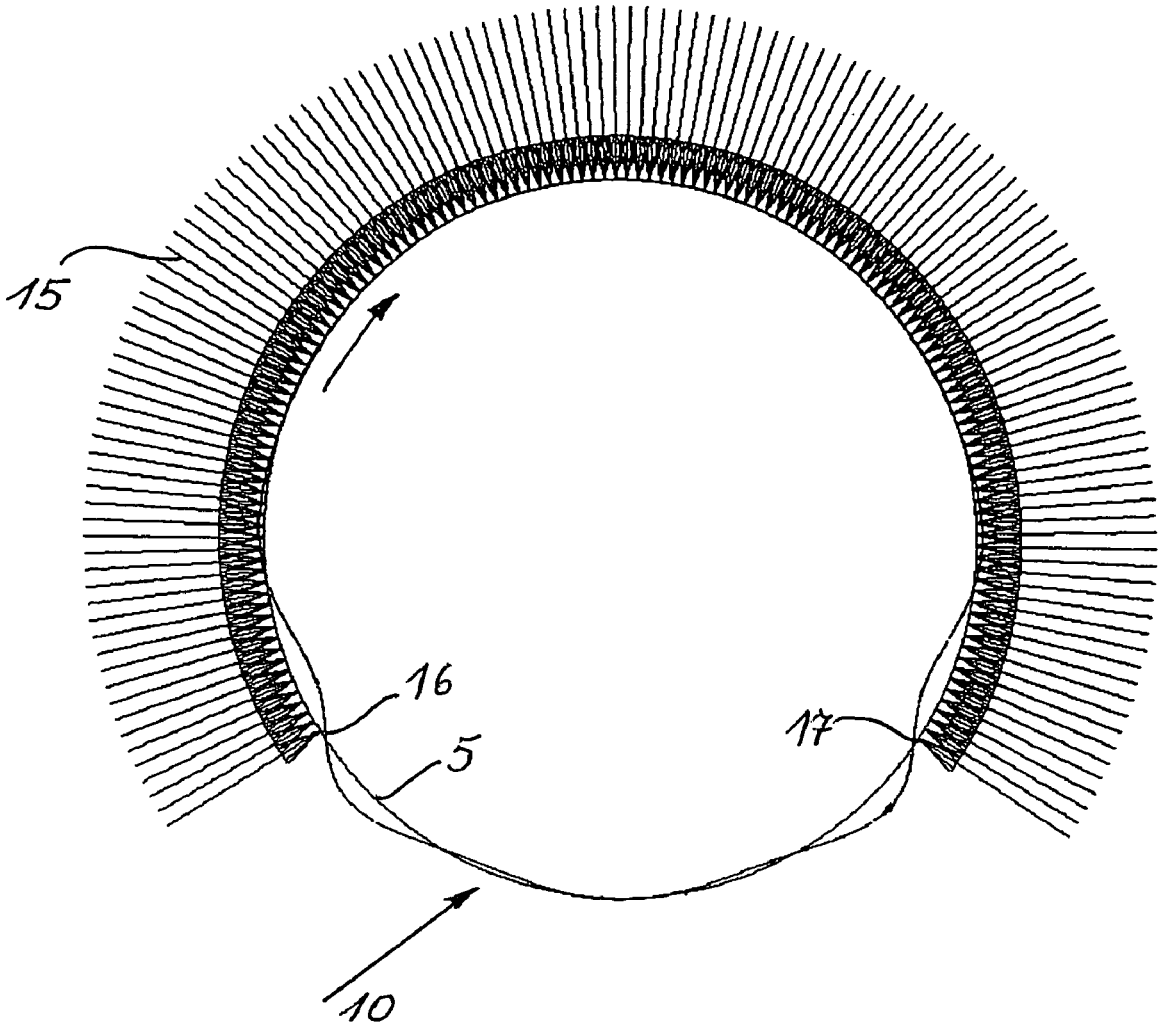
Figure 7:
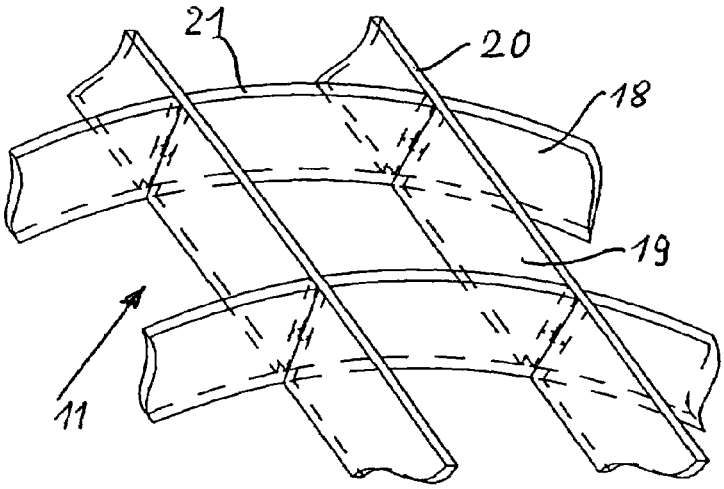
Figure 8:
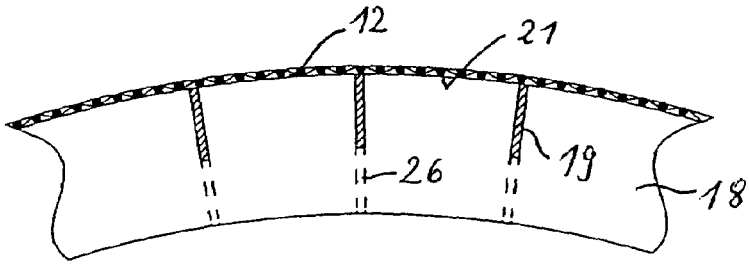
Figure 9:
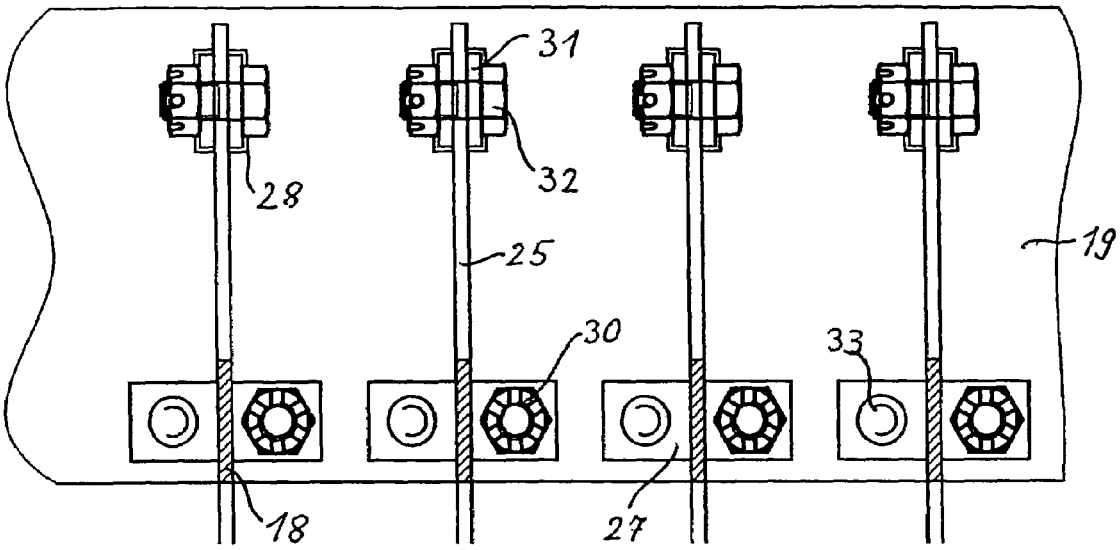
Figure 10:
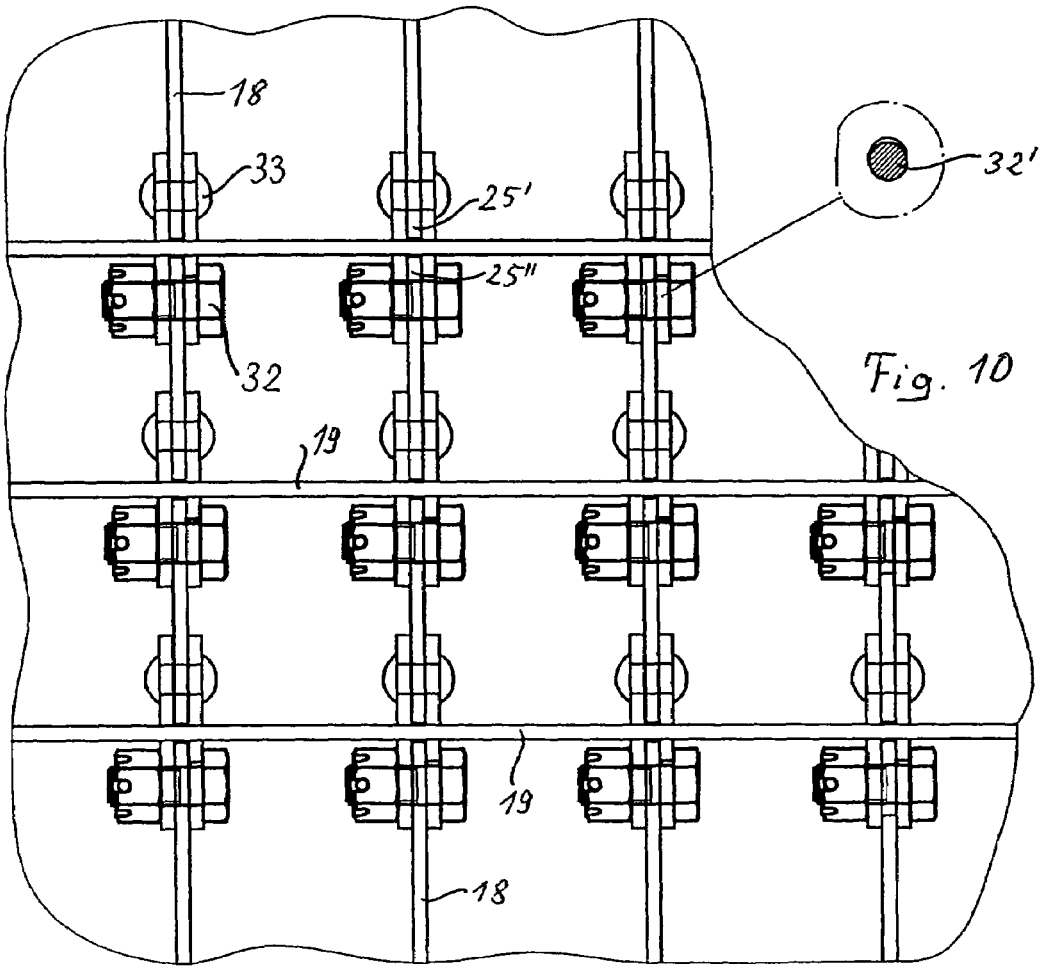
Figure 11:
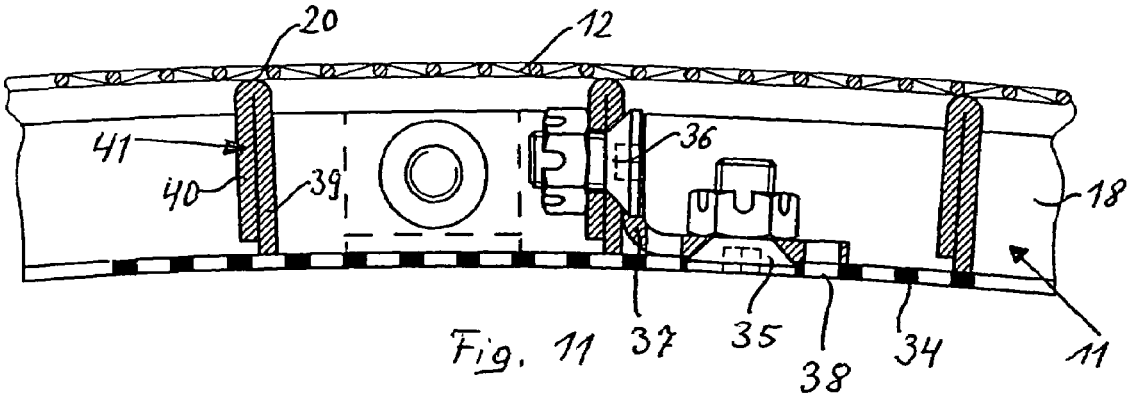
Figure 12:
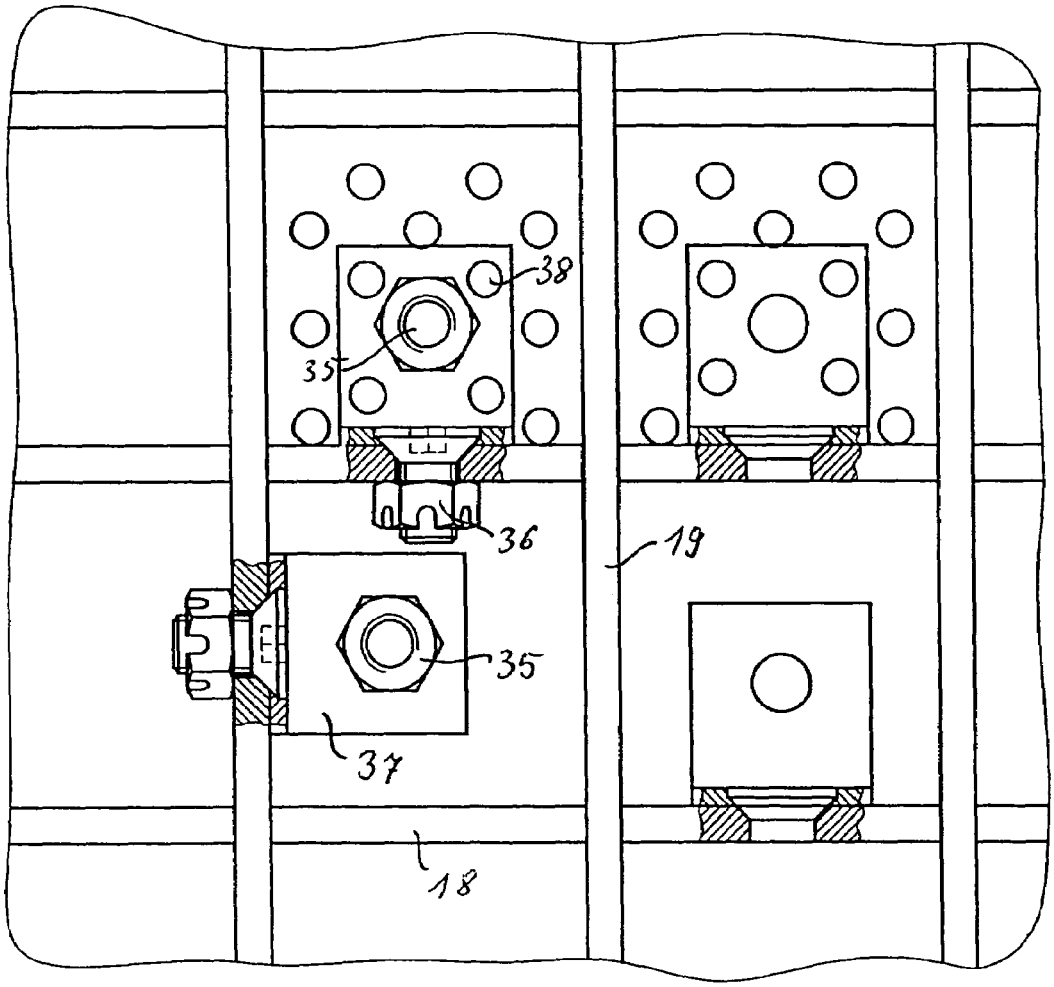

A device of the type according to the invention is shown as an example in the drawings. Further advantageous and inventive details of the drum structure will be explained with reference to these examples. In the figures:

FIG. 1 is a cross-sectional view of a conventional screen drum structure with the screen drum shown in longitudinal cross-section, FIG. 2 is an enlarged section of the drum jacket with the sheet-metal strips shown in cross-section, FIG. 3 is a cross-sectional view of the entire drum with the pressure distribution as a result of the ensuring air pressure and resulting bending stress of the drum jacket, FIG. 4 to 8 individual parts and perspective view of the sheet-metal strip structure of the drum jacket, FIG. 9 shows a sheet-metal strip viewed with the sheet-metal rings running perpendicular thereto in cross-section, FIG. 10 shows a plan view of the sheet-metal strip structure from FIG. 9, FIG. 11 is the drum jacket similar to FIG. 2 with a different embodiment of the sheet-metal strips and FIG. 12 shows the sheet-metal structure similar to FIG. 10 with the mechanical fixing of the sheet-metal strip jacket on the screen drum.

A screen drum device for heat treatment basically consists of an approximately rectangular housing 1 which is divided by a partition wall 2 into a treatment compartment 3 and a fan compartment 4. The air-permeable drum 5 is rotatably mounted in the treatment compartment 3 and a fan 6 is rotatably mounted in the fan compartment 4 concentrically thereto. Naturally, the fan compartment can also be arranged in a separate fan housing, not shown here, which is separate from the drum housing 1. In any case, the fan sets the interior of the drum 5 under an induced draught and delivers the heated air via a screen cover 7, which serves as a baffle, into the treatment compartment 3, uniformly distributed over the drum length.

The new drum structure is also the subject matter of the patent on a wet treatment device which can only be used to remove liquid by suction. The overall structure should then be adapted accordingly.

According to FIG. 1, heating systems 8 consisting of pipes through which heating medium flows, are arranged above and below the fan 6. The drum is covered against the induced draught by an inner cover 10 arranged here at the bottom in the area not covered by textile 9. The supporting jacket of the drum 5 is formed by the sheet-metal strip structure 11 described further below. This has a fine-meshed screen 12 wrapped around the outside, which is held tensioned on the front sides of the drum, at the two bottoms 13, 14.

The textile to be treated 9 lies on the wire gauze 12, on the jacket of the drum 5, under a pressure loading produced by the accelerated air. The pressure loading 15 acting around the drum is shown schematically in FIG. 3. Since the textile 9 only partly covers the circumference of the drum 5 however, in the region 10 where the drum 5 is not covered by textile, there is an inner covering so that no effective air pressure acts on the jacket there, as is shown in FIG. 3. This continuous change in load caused y the rotation of the drum, especially at the beginning 16 of the inner covering and at its end 17, brings about a change in the true-running accuracy of the drum jacket at least in the long run. This has the result that the textile or the tissue or paper no longer lies uniformly on or over the complete surface of the drum jacket. Creases form in the goods and the drum becomes unusable in the long run.

Figure 4:
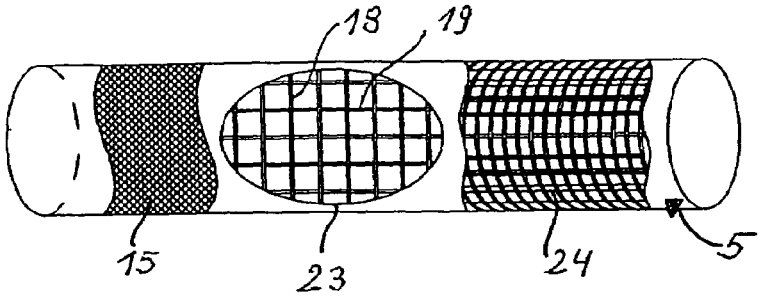
Figure 5:
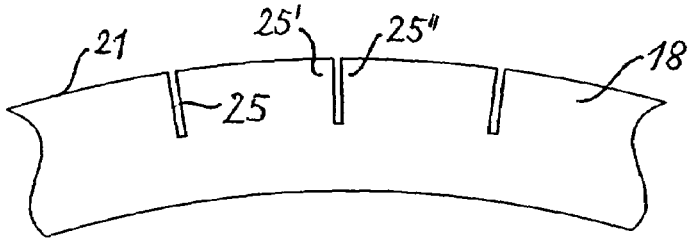
Figure 6:
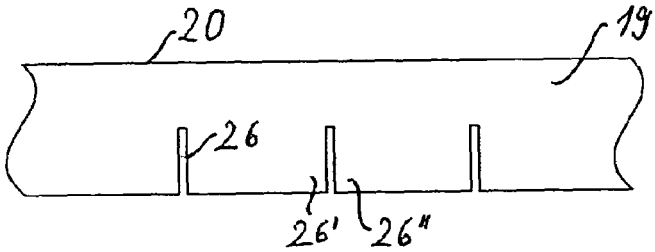

In order to increase the bending resistance of the drum, a sheet-metal strip structure has been developed whose principle is deduced from FIG. 4-8. The drum 5 as shown in FIG. 4, has a small diameter in relation to its length. This is different when a structure for heat treatment of a material web is involved. The drum 5 consists of an inherently rigid sheet-metal strip structure which consists of the sheet-metal rings 18 according to FIG. 5 and the sheet-metal strips 19 extending over the entire length of the drum as shown in FIG. 6. The thickness of the sheet metal for the sheet-metal rings and sheet-metal strips can be 4 or 5 mm and their spacing can be 40 mm or more. The dimensions are determined by the desired and necessary stability of the rollers.

The sheet-metal strips 19 are arranged at the same radial height as the sheet-metal rings 18 as shown in FIG. 7, the outer edges 20 and 21 thus form the outer circumferential surface of the drum and bear the wire gauze 12 which is shown on the left in the plan view in FIG. 4. The circular section 23 in FIG. 4 shows an enlarged view of the jacket structure with the sheet-metal strips 19 and sheet-metal rings 18 intersecting at right angles and the section 24 shows a plan view of the drum 5 without the wire gauze 12. It is more advantageous for the treatment of material webs free from markings if the sheet-metal strips 19 project radially with their outer edge 20 with respect to the sheet-metal rings 18. This is shown in FIG. 8.

The sheet-metal rings 18 have radially outward individual insertion slots 25 arranged the same distance apart, which are exactly radially aligned. The width of the insertion slots corresponds to the cross-section of the sheet-metal strips 19 such that the sheet-metal strips can be inserted into the sheet-metal rings and thereby held fixedly in the sheet-metal rings.

The sheet-metal strips 19 as shown in FIG. 6 have radially inward corresponding insertion slots 26 with the same spacing, which are incorporated precisely at right angles to the edge 20 of the sheet-metal strips 19. The width of these insertion slots 26 also corresponds to the cross-section of the sheet-metal rings 18 so that the sheet-metal strips 19 can be inserted as far as the outer edge 21 of the sheet-metal rings 18 as shown in FIG. 7 and thereby held fixedly in the sheet-metal rings 18. The radial depth of the insertion slots 25 and 26 is approximately up to half the radial height of the strips 19 and rings 18 so that both the outer and the inner surface of the drum structure is formed by both intersecting sheets. The inner surface of the drum can, however, also be formed only by the rings 18 whereas the outer surface can advantageously only be formed by the sheet-metal strips 19.

It can be seen from FIG. 7 how the sheet-metal strips 18 and rings 19 intermesh in the assembled state. Depending on the fitting accuracy of the slots 25, 26 and the thickness of the sheets, the structure can be sufficiently stable merely as a result of the friction of the sheets with respect to one another. However, this depends on the intended usage of the drum. It is provided here to screw the sheet together at the longitudinal edges of the slots as is described with reference to FIGS. 2 and 9–12.

The diagram in FIG. 8 corresponds to that in FIG. 2 except that the sheet-metal strip structure 11 according to FIG. 2 is an inherently stable self-supporting structure. For this purpose the sheet-metal strips 19 in the area of their lower slots 26 and the flanks 26', 26" of the slots 26 are mechanically connected by the material of the sheet-metal rings 18. This could naturally also be accomplished using welded seams but these would change the structure of the strip material because of the heat produced during the welding and the drums would become distorted. Here, however, connecting plates 27, 31 are provided, which interconnect the flanks 25', 25" and 26', 26" of the slots in the area of the respective slots 25, 26. Since the respective wall of the neighbouring strip is in the way for this, an opening 28, 29 must be cut in this wall through which the connecting plates 27, 31 can be pushed. The openings 29 in the sheet-metal rings 18 can be seen from FIG. 2 and the openings 28 in the sheet-metal strips 19 can be seen from FIG. 9. They are always incorporated so that the mechanical connection between the plates can be made at the outer ends of the slots 25, 26. In this respect, the radially inner slots 26 of the sheet-metal strips 19 are anchored by plates 27 with screws 30 as shown in FIG. 2. On the other hand, the longer radially outer slots 25 of the sheet-metal rings 18 are anchored by plates 31 with screws 32, as shown in FIG. 9. The plates 27 are pushed through the openings 29 in the sheet-metal rings 18 whereas the plates 31 are pushed through the openings 28 in the sheet-metal strips 19. More appropriately, such connecting plates are incorporated on both sides of the respective strip or ring to increase the stability of the strip structure 11. The screws 30, 32 can be replaced by rivets 33. In order to allow exact parallel adjustment of the slot flanges 25', 25"; 26', 26", the bolt of the screw 25 is provided with an eccentric 32', as shown in the enlarged section in FIG. 10, so that when the screw 32 is not yet tightened, the flanges 25', 25" can be pulled together and aligned parallel by means of the eccentric 32' by turning the screw head of the screw 32. This particularly applies to the longer slots 25 in the sheet-metal rings 18.

FIG. 11 corresponds to the diagram in FIG. 2. The connection of the sheet-metal strips to the sheet-metal rings is omitted there. In addition to the sheet-metal strip structure 11, in the construction shown in FIGS. 11 and 12 a further perforated screen drum 34 is provided which abuts directly on the lower edges of the sheet-metal strips 19 radially inwards of the sheet-metal strip structure 11. This structure should also be connected mechanically to the sheet-metal strip structure 11, and specifically using screws 35, 36 which grip through angle irons 37 and then through truss and drum or ring and drum. The angle irons 37 are also perforated for air to flow through, as is deduced from FIG. 11, reference number 38.

FIG. 11 discloses a different structure of sheet-metal strips. These are formed of a curved sheet and specifically so that the two flanges 39, 40 lie fixedly on one another, bent by 180° with respect to one another, and together form the sheet-metal strips 41 which are radially outwardly rounded as a result of the bending. This has the advantage that the sheet-metal strip 41 optionally made of thinner sheet has greater stability but it also has a round upper outer surface 20' for positioning the wire gauze 12 with lower wear.

The invention claimed is:

1. A device for flowing or pressure treatment of textiles, nonwovens, tissue or paper comprising a treatment agent which is gaseous or liquid in the device, and is optionally also circulated, comprising a permeable drum having bottoms at the front and located under an induced draught, which serves as a transporting and supporting element for the material and which is covered for this purpose with a screen-shaped coating on its circumference, wherein sheet-metal strips extend straight without bending from one bottom to another between the bottoms of the drum to form the drum jacket, their width expansion extending substantially in the radial direction, and sheet-metal rings held on the sheet-metal strips are arranged between the sheet-metal strips, distributed uniformly over the length of the drum, wherein sheet-metal strips and sheet-metal rings can be pushed into one another and for this purpose both the sheet-metal strips and the sheet-metal rings are provided with radially directed insertion slots, characterised in that the free flanks of the insertion slots of the sheet-metal strips and of the sheet-metal ring are fixedly interconnected by means of at least one additional connecting plate in each case.

2. The device according to claim 1, characterised in that for connecting the flanges of the slots of the sheet-metal strips, the associated sheet-metal ring is provided with an opening through which at least one connecting plate can be pushed for mechanical connection of the neighbouring sheet-metal strip flanges.

3. The device according to claim 1, characterised in that for connecting the flanges of the slots of the sheet-metal ring, the associated sheet-metal strip is provided with an opening through which at least one connecting plate can be pushed for mechanical connection of the neighbouring sheet-metal ring.

4. The device according to claim 1, characterised in that a connecting plate is arranged on both sides of the sheet-metal ring or the sheet-metal strip at the height of the respective slot.

5. The device according to claim 1, characterised in that the respective connecting plate is affixed with screws and/or rivets to the associated flanges.

6. The device according to claim 5, characterised in that the screw is provided with an eccentric which can brace the connecting plate with respect to the flanges to be joined.

7. The device according to claim 1, characterised in that the sheet-metal rings are provided with the insertion slots on their outer side (radially outwards) and are provided with the connecting plates on their radial outer side.

8. The device according to claim 1, characterised in that the sheet-metal strips extend from bottom to bottom without slots on their outer side and are provided with the connecting plates on their radial inner side.

9. The device according to claim 1, characterised in that the insertion slots are the same distance apart.

10. The device according to claim 1, characterised in that the width of the insertion slots only allows the sheet-metal strips to be pushed into the sheet-metal rings free from play.

11. The device according to claim 1, characterised in that the sheet-metal strips have a greater radial height than the sheet-metal rings and project radially outwards with respect to the sheet-metal rings whereby the screen-shaped coating is only supported on the sheet-metal strips which extend from one bottom to the other without slots.

12. The device according to claim 1, characterised in that the radial depth of the insertion slots in the sheet-metal strips and sheet-metal rings is of different lengths and specifically is small in the sheet-metal strips and greater in the sheet-metal rings.

13. The device according to claim 1, characterised in that the sheet-metal strips and rings intersect at right angles in the sheet-metal drum.

14. The device according to claim 1, characterised in that the radially inner edges of the sheet-metal strips and rings end at the same height.

15. The device according to claim 1, characterised in that the sheet-metal strips are formed of a curved sheet whose curved edge is arranged radially outwards in the drum structure.

16. The device according to claim 15, characterised in that the sheet-metal strips are formed from a sheet curved such that the two flanges lie fixedly on one another bent through 180° with respect to one another, and the two flanges together form the radially outwardly rounded sheet-metal strip as a result of the bending.

17. The device according to claim 1, characterised in that an additional sheet-metal drum provided with openings like a perforated screen drum is arranged radially inwards directly underneath the inner edges of the sheet-metal strip structure parallel over the entire length of the drum so that the jacket of the drum now consists of a radially outwardly arranged strip-shaped sheet-metal strip structure which has been screwed together, comprising wire gauze and an additional sheet-metal drum on the inside.

18. The device according to claim 17, characterised in that the square-shaped sheet-metal structure is screwed to the sheet-metal ring over its surface.

19. The device according to claim 18, characterised in that one of two flanges of rectangular metal clips is either screwed to a sheet-metal strip or a sheet-metal ring and the other flange is screwed to the sheet-metal drum.

20. The device according to claim 19, characterised in that the flange of the metal clips screwed to the sheet-metal drum is provided with aligned holes according to the perforation of the screen drum.

21. The device according to claim 19, characterised in that the screw held of the screw acting on the sheet-metal drum and connected to the angle is recessed in the sheet metal of the screen drum.

* * * * *